US005547124A

United States Patent [19]

Mueller

[11] Patent Number: 5,547,124

[45] Date of Patent: Aug. 20, 1996

[54] HEAT INSULATING CONTAINER

[75] Inventor: Berthold Mueller, Suessen, Germany

[73] Assignee: Michael Hoerauf Maschinenfabrik GmbH & Co. KG, Germany

[21] Appl. No.: 503,630

[22] Filed: Jul. 18, 1995

[51] Int. Cl.[6] ..... B65D 3/22

[52] U.S. Cl. ..... 229/403; 220/445; 229/4.5; 493/111; 493/128

[58] Field of Search ..... 229/4.5, 400, 403; 220/445; 493/111–113, 128, 296, 297, 298, 386–389, 908

[56] References Cited

U.S. PATENT DOCUMENTS

| | | | |
|---|---|---|---|
| 1,756,243 | 4/1930 | Benson | 493/128 |
| 1,771,765 | 7/1930 | Benson | 229/4.5 |
| 2,252,360 | 8/1941 | Barbieri | 229/4.5 |
| 2,661,889 | 12/1953 | Phinney | 229/4.5 |
| 2,853,222 | 9/1958 | Gallagher | 229/403 |
| 3,759,437 | 9/1973 | Amberg | 229/4.5 |
| 3,908,523 | 9/1975 | Shikaya | 493/111 |
| 5,205,473 | 4/1993 | Coffin, Sr. | 229/403 |
| 5,226,585 | 7/1993 | Varano | 229/403 |
| 5,363,982 | 11/1994 | Sadlier | 493/111 |

OTHER PUBLICATIONS

"Distribution Packaging" by Friedman & Kipnees, Roger E. Krieger Pub. Co., (1977) pp. 272, 273.

*Primary Examiner*—Gary E. Elkins

*Attorney, Agent, or Firm*—Evenson, McKeown, Edwards & Lenahan, P.L.L.C.

[57] ABSTRACT

A heat insulating container has an inner container body and a sleeve. The sleeve is attached to the circumferential wall of the inner container body by attaching surfaces, and has cut edges extending transversely to the circumferential direction. The attaching surfaces are only arranged extending transversely to the circumferential direction. A simplified application of the sleeve to the circumferential wall of the inner container is thereby made possible and less material and working time are required for production.

17 Claims, 4 Drawing Sheets

HEAT INSULATING CONTAINER

BACKGROUND AND SUMMARY OF THE INVENTION

The present invention relates to a heat insulating container comprising an inner container body and a sleeve which has cut edges extending transversely to the circumferential direction of the container and being attached to the circumferential wall of the inner container by attaching surfaces. The present invention also relates to a process for making a heat insulating container comprising an inner container body and a sleeve from a flat blank and wrapped around the inner container body.

U.S. Pat. No. 5,226,585 describes a known container in which two attaching surfaces extend circumferentially of the container. These attaching surfaces are arranged at the border areas of two sleeve cut edges which extend in circumferential direction. Two other sleeve cut edges extend transversely to the circumferential direction, whereby the border area of one cut edge overlaps the border area of the other cut edge. A further attaching surface is arranged on the inner border area.

It is an object of the present invention to reduce working time and/or the amount of material needed for making a container without lessening the insulating effect.

This object has been achieved in accordance with the present invention by arranging all attaching surfaces extending transversely to the circumferential direction.

With regard to the production process, this object has been achieved in that the blank is wrapped around the inner container body such that two cut edges come to lie facing each other, transversely to the circumferential direction. Thereafter, the blank is attached at those areas bordering the named cut edges, to the inner container body in one procedural step.

Due to the sleeve being attached transversely to the circumferential direction, attaching surfaces extending in circumferential direction are superfluous. Attaching surfaces which extend transversely to the circumferential direction can be applied to the sleeve in less working time and usually with less material than attaching surfaces which extend in circumferential direction. This attachment is entirely sufficient. The sleeve's function is primarily that of heat insulation. This heat insulation function is not impaired by the attachment methodology of the present invention.

The invention can be applied to any type of container, regardless of form, while a variety of materials can be used for the container. The sleeve can be made of one material layer or comprise several layers.

In one advantageous embodiment, at least a part of the attaching surfaces are arranged at those edge areas which border the cut edges extending transversely to the circumferential direction. The advantageous arrangement guarantees a secure holding of the longitudinal ends of the sleeve. Additional measures to ensure against detachment of the longitudinal ends, which are especially at risk, are thus not necessary.

In a further embodiment of the present invention, at least one additional attaching surface is arranged at a distance to the cut edges extending transversely to the circumferential direction. A more secure attachment of the sleeve is thus ensured. It is hereby purposeful if the at least one additional attaching surface is arranged halfway between the distance to the cut edges extending transversely to the circumferential direction. Further attaching surfaces at a distance to the cut edges are then, as a rule, superfluous.

In a still further advantageous embodiment of the invention, the sleeve is attached to the circumferential wall of the inner container by a tensile stress working in circumferential direction. This ensures that the sleeve also lies on the inner container outside of the attaching surfaces and that those edges bordering the cut edges extending in circumferential direction do not lift off.

In yet another advantageous embodiment of the invention, the cut edges extending transversely to the circumferential direction face each other so that those edges bordering thereon do not overlap each other. The attaching surfaces of both border areas are then in contact with the circumferential wall of the inner container. The attachment can therefore be simplified as, for example, the attaching structure for both border areas can be applied to the inner container. In addition thereto, the border areas are less at risk of lifting off owing to the lack of overlap. This applies in particular when the sleeve has been wound in abutting relationship. There is the further advantage that the containers, as a result of the lack of overlap, do not thicken at any point, and are thus easy to handle. For example, they can be stacked.

In still another advantageous embodiment of the present invention, the sleeve has profilings projecting outwardly or inwardly. The profilings can be arranged on a single material layer, if the sleeve comprises plurality of material layers. Hollow spaces arise between the inner container and the inside of the sleeve owing to the profiling, and this arrangement results in an increase in heat insulation. It is thereby possible to use thinner material which is easy to work with. It is advantageous to arrange the profilings proportionally over the surface of the sleeve.

It is practical to arrange the attaching surfaces onto profilings. The amount of attaching structure can thus be reduced. It is not necessary, although of course possible, to also fill the hollow spaces bordering on the profilings with the attaching structure. In another advantageous feature, the profilings can be arranged on those areas bordering the cut edges, and attaching surfaces can be provided on the profilings. In many cases it can be more economical to arrange the profilings in any way desired. The attaching surfaces are then arranged independent of the position of the profilings.

It is also advantageous to arrange at least a number of the profilings transversely to the circumferential direction. This results in the attaching surfaces, which extend transversely to the circumferential direction, lying on the profilings. This applies also when the position of the profilings is not fixed during application the sleeve. In the latter case, the attaching surfaces must have a sufficient extent in circumferential direction, so that they too surround the profilings.

It is practical for the sleeve to have hollows which correspond to the projecting profilings. The hollows are situated on side of the sleeve opposite the profilings, or on the material layer of the sleeve which comprises the profilings. The profilings and hollows can be simply made, for example by stamping.

It is further advantageous to form the profilings as small round protrusions which can project inwardly or outwardly. It is useful to cover the material layer comprising the small round protrusions with an additional material layer on the outside.

In another still further advantageous embodiment of the present invention, the profilings are formed as ridges extending transversely to the circumferential direction. These ridges can be made in a simple way by stamping, whereby groove-like hollows arise which correspond to the ridges. It is particularly advantageous when the ridges project outwardly.

The profilings can take many forms. The profilings can, for example, extend wave-like in circumferential direction, so that corrugated cardboard could be used for the sleeve.

It is advantageous for the sleeve to comprise only one heat insulating material layer. A good insulating container can hereby be made with less work and material. This embodiment is, for example, then practical when it is provided with ridges projecting inwardly and extending transversely to the circumferential direction. Although visible from the outside, the groove-like hollows do not impair the insulating effect. When handling the container, the user does not come into contact with the inside of the hollows, provided that the hollows are not too wide.

It is practical for at least one of the sleeve and the inner container to comprise at least one material layer of paper or cardboard. These materials are particularly suitable for the production of a heat insulating container because they are easy to process.

In an further advantageous embodiment of the present invention, the attaching surfaces border directly onto the cut edges.

In yet another advantageous embodiment of the present invention, the sleeve is attached to the circumferential wall of the inner container by means of a gluing agent or by heat-sealing.

In one currently preferred embodiment of the present invention, the attaching surfaces, which are situated in the area of the cut edges which extend transversely to the circumferential direction, are attached to the circumferential wall of the inner container by a joint adhesive, such as, for example, glue or heat-sealable synthetic material. The joint adhesive makes possible the attachment of the sleeve to the above mentioned attaching surfaces in one procedural step.

If glue is used as the joint adhesive, a uniform layer thereof can be applied, transversely to the circumferential direction, to the circumferential wall of the container. The attaching surfaces can then be pressed against the glue layer in the area of both cut edges. A glued joint arises on each attaching surface.

If heat-sealable synthetic material is used as the joint adhesive, it is possible to apply a uniform plastic layer, extending transversely to the circumferential direction, to the circumferential wall of the container, which is melted into a heat sealing joint. This heat sealing joint joins the attaching surfaces in the area of both cut edges to the inner container.

BRIEF DESCRIPTION OF THE DRAWINGS

These and further objects, features and advantages of the present invention will become more readily apparent from the following detailed description thereof when taken in conjunction with the accompanying drawings wherein.

DETAILED DESCRIPTION OF THE DRAWINGS

Figure 1:
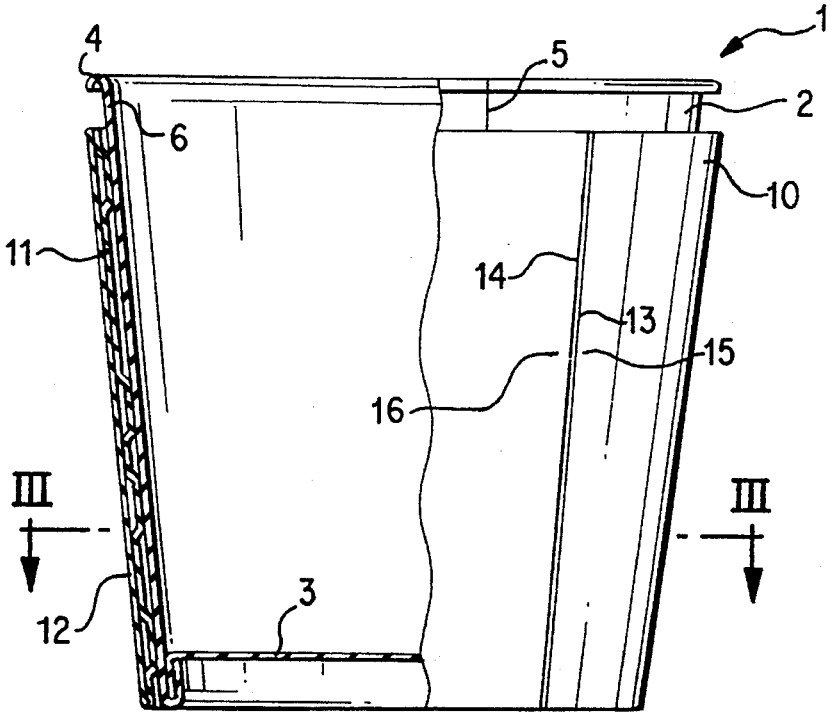
FIG. 1 is a first embodiment of a heat insulating container, comprising a sleeve with a plurality of material layers in a partly sectional longitudinal view.
Figure 2:
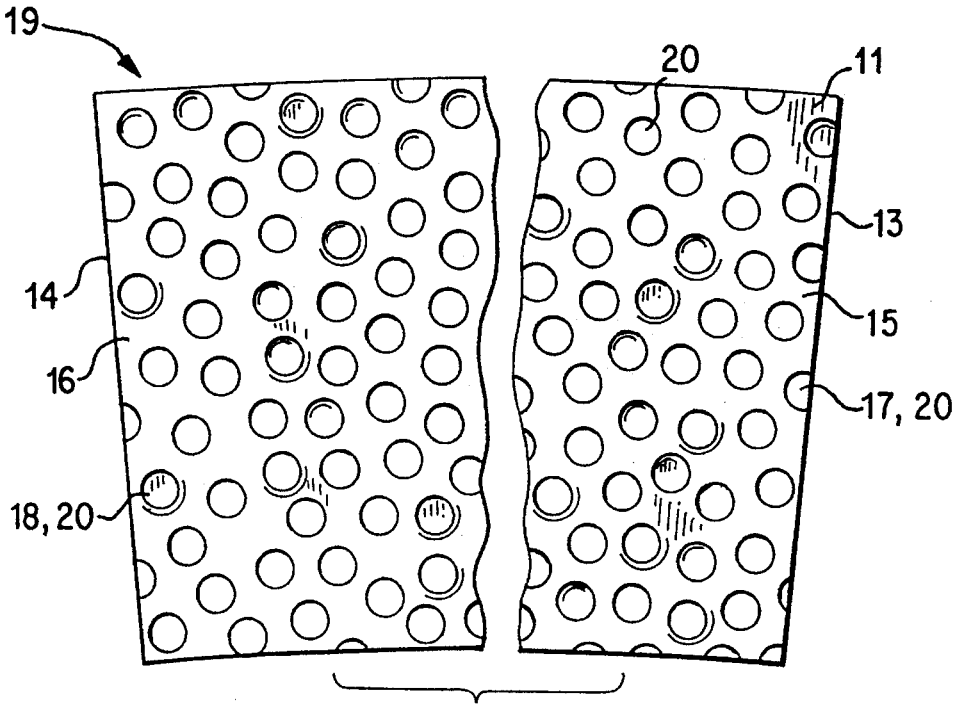
FIG. 2 is a blank for a sleeve material layer for the container in FIG. 1.
Figure 3:
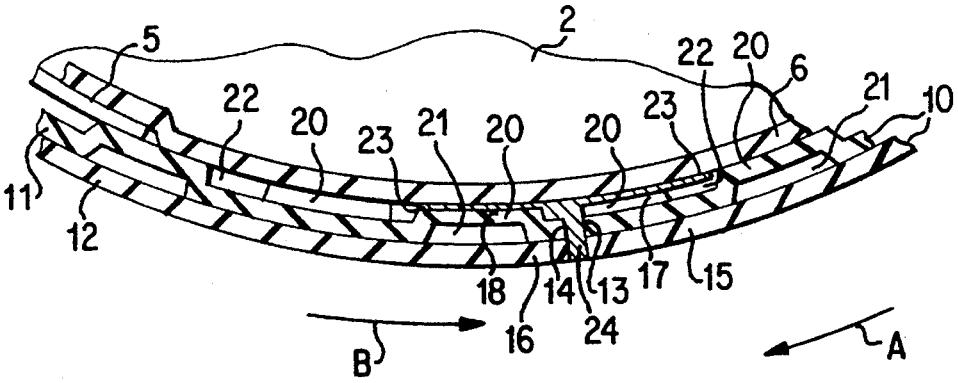
FIG. 3 is a partial cross section along the line III—III of the container in FIG. 1 on an enlarged scale.

The first embodiment of the heat insulating container 1 as shown in FIGS. 1 to 3 is essentially comprised of a truncated inner container 2 and a sleeve 10 joined together. The sleeve 10 has heat insulating properties and surrounds the circumferential wall 6 of the inner container 2.

The circumferential wall 6 is made from a flat blank which contains one material layer of paper as well as other material layers (not shown) of, for example, plastic. The blank is formed into a truncated sleeve, whereby two long ends of the blank are joined together by a sleeve seam 5 (FIG. 3). The smaller front opening of the sleeve is closed by a bottom 3, which is made of the same material as the circumferential wall 6. The larger front opening of the sleeve is enclosed by a border 4. The border 4 is smoothed down at the front side to accommodate the application of a cover such as, for example, a foil.

The sleeve 10 is also made from a flat blank. The blank is wrapped around the circumferential wall 6 of the inner container 2 and thus acquires the truncated shape of the inner container 2. The sleeve 10 comprises an inner material layer 11 and an outer material layer 12 joined together. Both material layers 11 and 12 consist essentially of paper. They are attached together before the blank is made, at the latest before being applied to the circumferential wall 6. A blank comprising two material layers 11, 12 is wrapped around the inner container 2 to form the sleeve 10. It is, of course, within the scope of the present invention to form the material layers 11, 12 as separate blanks and to wrap them, one after the other, around the inner container 2.

In the above described embodiment of the present invention, the blank, comprising two material layers 11, 12, is wrapped around the circumferential wall 6 in such a way that its cut edges 13, 14 (FIG. 2) come to lie transversely to the circumferential direction A, B and face each other. The circumferential direction A, B is understood to be both directions around the circumference, that is, the clockwise direction A in FIG. 3, and the counterclockwise direction B. Arrow A hereby denotes the direction to the cut edge 13 and arrow B denotes the opposite direction, that is, the direction to the cut edge 14. Both cut edges 13, 14 lie facing each other with a short distance in between, so that a narrow gap extending transversely to the circumferential direction A, B is formed. Those areas 15, 16 bordering the cut edges 13, 14 of the sleeve 10 do not overlap one another.

While being wrapped around, the blank is held under tensile stress in circumferential direction A, B, that is, in the direction to both cut edges 13, 14. The blank forming the sleeve 10 hereby is laid down firmly around the circumferential wall 6 of the inner container 2. The tensile stress remains after the sleeve 10 has been attached to the inner container 2, which process will be described below. This explains why, when the container 1 is finished, the sleeve 10 lies permanently firmly on the inner container 2.

It is possible within the scope of the present invention, in another embodiment (not shown), to form the blank and wrap it around the circumferential wall 6 such that the cut edges, extending transversely to the circumferential direction A, B do not form a gap, but rather rest against each other.

The sleeve 10, as can be seen in particular in FIG. 3, is attached to the inner container 2 at the border areas 15, 16 which extend transversely to the circumferential direction A, B and which border the cut edges 13, 14. This will be described below.

FIG. 2 shows a blank 19 of the inner material layer 11, namely the side of the inner material layer 11 facing the inside of the container 1 after being wrapped around same. The inner material layer 11 is provided with a plurality of round-shaped protrusions 20 projecting towards the observer. The protrusions 20 are arranged over the entire surface of the material layer 11, and can be produced in a simple way by stamping, whereby the protrusions 20 are pressed out of the plane material layer 11. On the side opposite to the protrusions 20, bowl-shaped hollows 21 arise (see also FIG. 3) thereby and correspond to the protrusions 20, thus also being round-shaped.

As seen in FIG. 3, the protrusions 20 are formed as attaching surfaces 17, 18 in the border areas 15, 16. In addition, the surfaces between the protrusions 20 on the border areas 15, 16 also serve as attaching surfaces, as they also come into contact with the attaching means, which will be described below.

The inner material layer 11 and the outer material layer 12 are attached to each other such that the protrusions 20 are facing the inner container 2 and the bowl-shaped hollows 21 are facing the outer layer 12. In another embodiment (not shown), it is also possible, within the scope of the present invention, to attach the inner material layer 11 and the outer material layer 12 to each other so that the hollows 21 are facing the inner container 2 and the protrusions 20 are facing the outer material layer 12.

In the embodiment shown in FIGS. 1 to 3, the protrusions 20 lie against the circumferential wall 6 of the inner container 2. Hollow spaces 22 are formed between the inner material layer 11 and the circumferential wall 6 of the inner container 2.

As seen in FIG. 3, a common attaching structure is arranged between the sleeve 10 and the circumferential wall 6 at those areas 15, 16 which border the cut edges 13, 14. A heat-sealing plastic layer 23 is used as an attaching structure, which is applied onto the circumferential wall 6 of the inner container 2 transversely to the circumferential direction A, B before the sleeve 10 is wrapped. In another embodiment (not shown), it is possible, within the scope of the present invention, to apply a separate heat-sealing plastic layer to the border areas of the two cut edges. A heat sealing attachment 24 is made from the plastic layer 23 for the sleeve 10 after the blank has been wrapped.

To make the heat sealing container 1, the inner container 2 is made first, and the plastic layer 23 is applied to the circumferential wall 6. The plastic layer 23 takes up a position which is out of line in circumferential direction A, B to the sleeve seam 5 of the inner container 2.

In a further procedural step, the flat blank for the sleeve 10, comprising two material layers 11, 12, is wrapped around the finished inner container 2 under tensile stress, as described above. The border areas 15, 16 of the blank come to rest on the plastic layer 23, whereby a small gap forms between the cut edges 13, 14. The tensile stress is retained, for example by a suitable holding means, after the wrapping.

In a later procedural step, the border areas 15, 16 of the blank, which has been wrapped around the inner container 2 while remaining under tensile stress, are attached by heat sealing to the circumferential wall 6 of the inner container 2. The heat sealing attachment 24 mentioned above is thereby made. The making of the heat sealing attachment 24 for both border areas 15, 16 takes place in a single procedural step. The heat sealing implement is formed in such a way that it is effective on both border areas 15, 16.

During heat sealing, the plastic layer 23 melts and spreads over the border areas 15, 16. As can be seen in FIG. 3, the heat sealing attachment 24, formed from the plastic layer 23 encompasses not only the attaching surfaces 17, 18 on the protrusions 20, but also the space between these protrusions 20 as well as the gap formed between the adjacent cut edges 13, 14.

As can be seen in FIGS. 1 and 3, the sleeve 10 is arranged in such a way at the circumferential wall 6 that the heat sealing attachment 24 is arranged out of line in circumferential direction B to the sleeve seam 5 of the inner container 2. A thickening of the container 1 in the area of the heat sealing attachment 24 is thus avoided. Because the border areas 15, 16 do not overlap each other, a thickening of the container 1 is also avoided. The hollows 21 and other hollow spaces 22 formed in the sleeve 10, together with the material used maintain a good heat insulation of the container 1.

Figure 6:
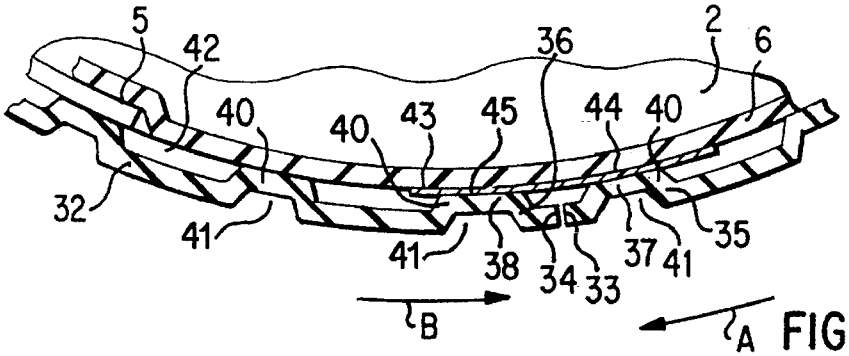
FIG. 6 is a partial cross-sectional view along the line VI—VI of the container in FIG. 4 on an enlarged scale.
Figure 4:
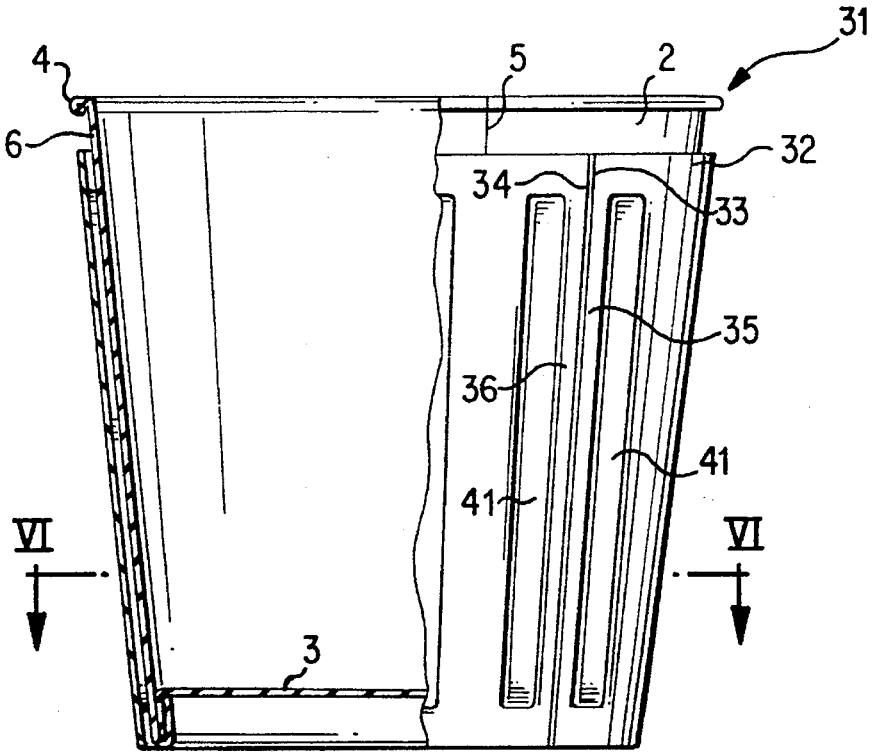
FIG. 4 is a second embodiment of a heat insulating container, comprising a sleeve of one material layer, in partial sectional longitudinal view.
Figure 5:
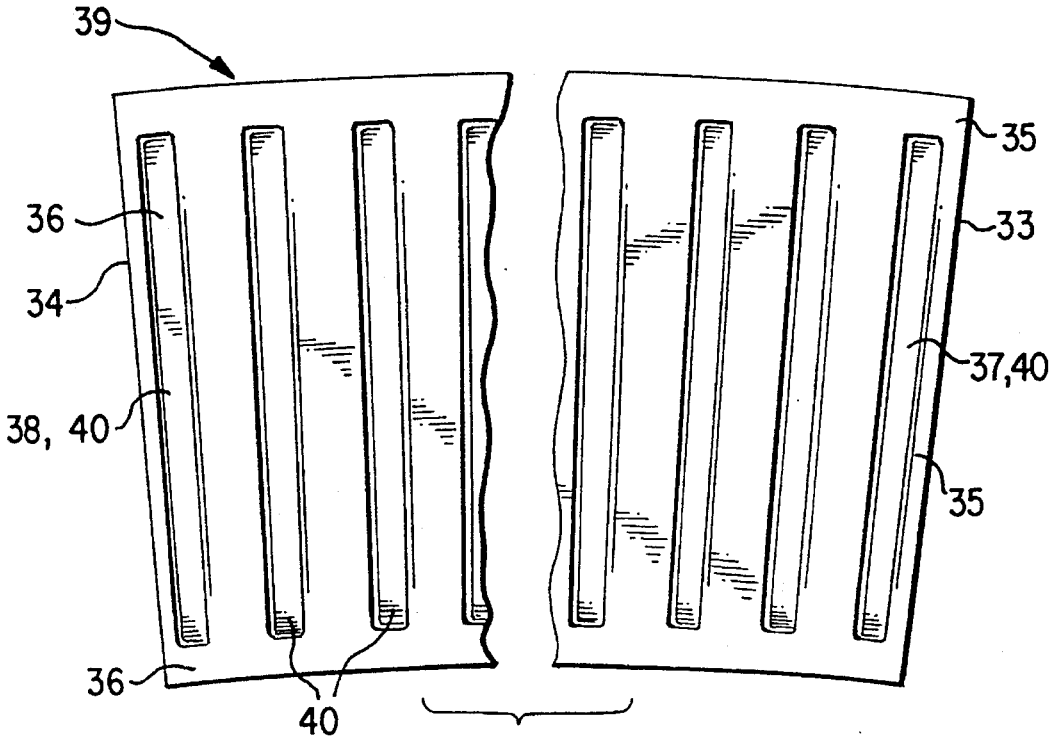
FIG. 5 is a blank for a sleeve material layer of the container in FIG. 4.

The second embodiment of a heat insulating container 31 shown in FIGS. 4 to 6 comprises, as does the container 1, an inner container 2 and a sleeve 32. The inner container 2 of the container 31 has the same form as the inner container 2 of the container 1.

The sleeve 32 of the container 31 differs from the sleeve 10 of the container 1 principally in that the sleeve 32 comprises only one material layer, and the profilings are formed differently to the profilings of the container 1. In addition, a different attaching mechanism is used than for container 1.

The sleeve 32 is formed from a blank 39 (see also FIG. 5) of paper, which is wrapped around the inner container 2 under tensile stress. The two cut edges 33, 34 come to lie transversely to the circumferential direction A, B of the container 31. The blank 39, under tensile stress, is attached at those border areas 35, 36 bordering the cut edges 33, 34 to the circumferential wall The blank 39 forming the sleeve 32 is shown in FIG. 5 in such a way that the side which rests on the circumferential wall 6 after wrapping is facing the viewer. The profilings are formed as ridges 40, extending transversely to the circumferential direction A, B, and projecting in the direction towards the viewer in FIG. 5. On the opposite side, groove-like depressions 41 are formed, which correspond to the ridges 40. As the sleeve 32 comprises only one material layer, the groove-like depressions 41 are visible from the outside.

At the border areas 35, 36, the ridges 40 are provided with attaching surfaces 37, 38, extending transversely to the circumferential direction A, B. The surfaces at the border edges 35, 36 outside of the ridges 40 do not serve as attaching surfaces, as they do not come into contact with the attaching structure described below. The attaching surfaces 37, 38 do not therefore border the cut edges 33, 34 directly.

As can be seen from FIG. 6, the ridges 40 lie against the circumferential wall 6, whereby hollow spaces 42 between the sleeve 32 and the inner container 2 are formed. The ridges 40 arranged at the border edges 35, 36, on which ridges 40 attaching surfaces 37, 38 are arranged, are attached to the circumferential wall 6 by a shared attaching structure. A shared adhesive layer 43 serves as an attaching structure, which is applied transversely to the circumferential direction A, B before the sleeve 32 is wrapped around the circumferential wall 6 of the inner container 2. The border areas 35, 36 are pressed against the adhesive layer 43 after the wrapping, whereby an adhesive connection 44 arises on the attaching surface 37 and an adhesive connection 45 arises on the attaching surface 38.

As in the embodiments of FIGS. 1 to 3, a small gap is also left here between the cut edges 33 and 34. In contrast to the first embodiment, however, the gap in FIG. 6 is not filled by the attaching structure. As the border areas 35, 36 of the sleeve 32 do not overlap each other, and the adhesive connection 44, 45 is arranged out of line in the circumferential direction B to the sleeve seam 5 of the inner container 2, a thickening of the container 31 is avoided. The hollow spaces 42 and the material used ensure good heat insulating properties of the container 31. The user does not come into contact with the narrow depressions 41 while handling the container 31, so that the reduced heat insulation in these areas does not impair the usability of the container 31.

Figure 7:
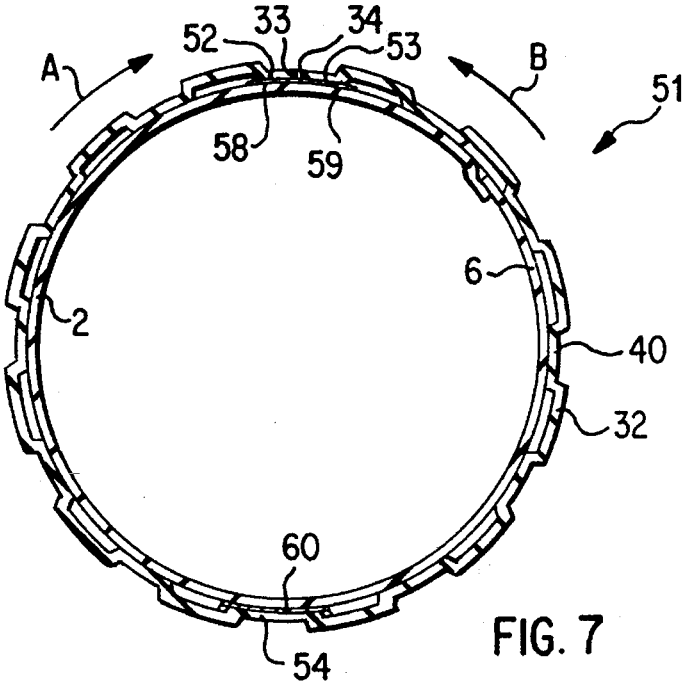
FIG. 7 is a cross-sectional view of a third embodiment of a heat insulating container similar to FIG. 6 but in a reduced scale.
Figure 8:
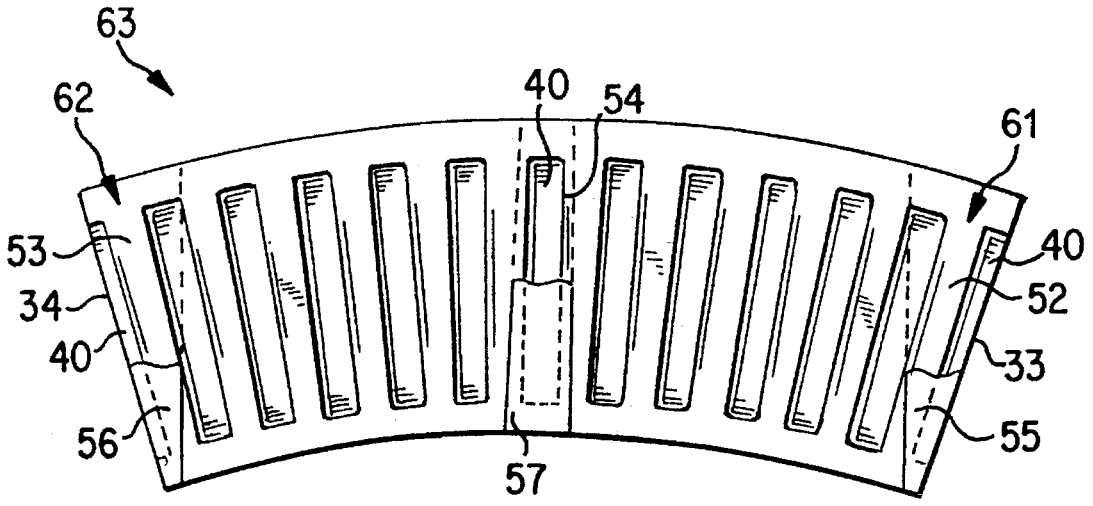
FIG. 8 is a blank for a sleeve material layer of the container in FIG. 7 in a reduced scale.

The third embodiment of a heat insulating container 51 as shown in FIGS. 7 and 8 comprises an inner container 2 and a sleeve 32, identical to that of the container 31 of the second embodiment. The inner container 2, as well as the sleeve 32 of the container 51 are identical in form to the inner container 2 and the sleeve 32 of the container 31 of the second embodiment. Only the ridges 40 of the sleeve 32 are drawn somewhat wider in FIGS. 7 and 8 than in FIGS. 5 and 6. The container 51 differs otherwise from the container 31 principally in that the sleeve 32 is attached to the inner container 2 in another way.

The sleeve 32 is formed from a blank 63 seen in FIG. 8, which has the same shape as the blank 39 of the second embodiment seen in FIG. 5.

Attaching surfaces 52, 53 are provided on those border areas 61, 62 of the blank 63 bordering the cut edges 33, 34. These attaching surfaces 52, 53 encompass not only the upper surfaces of the ridges 40, but also those areas adjacent to the ridges 40 which do not project upwards. The attaching surfaces 52, 53 are covered all over with adhesive layers 55, 56 shown in FIG. 8 only in the lower area of blank 63.

In addition to the attaching surfaces 52, 53, another attaching surface 54 is provided on the blank 63. This attaching surface 54 is arranged at a distance to the two cut edges 33, 34 which extend transversely to the circumferential direction A, B, namely halfway between the above mentioned cut edges 33, 34. The attaching surface 54 extends in the same way as the two attaching surfaces 52, 53 transversely to the circumferential direction A, B as seen in FIG. 7 and is also covered all over with an adhesive layer 57. This adhesive layer 57 is shown in FIG. 8 only in the lower area of the blank 63.

For making the heat insulating container 51, the inner container 2 is made first and the adhesive layers 55, 56, 57 are applied to the attaching surfaces 52, 53, 54 of the blank 63. In a later step the blank 63 is wrapped around the inner container 2. The blank 63 is hereby given a tensile stress in circumferential directions A and B seen in FIG. 7 towards the cut edges 33 and 34. The tensile stress is retained after the wrapping around.

In a later step, the blank 63, still under tensile stress, is attached to the inner container 2. The attaching surfaces 52, 53, 54 with the adhesive layers 55, 56, 57 are pressed onto the circumferential wall 6 of the inner container 2. An adhesive connection 58, 59, 60 arises at the attaching surfaces 52, 53, 54 between the blank 63 which now forms the sleeve 32 and the inner container 2. The container 51 now has the form shown in FIG. 7. As a tensile stress in circumferential direction A and B occurs after the binding of the sleeve 32 with the inner container 2, the sleeve 32 lies securely fixed over its entire surface to the inner container 2.

In the another embodiment (not shown), instead of a heat-sealable plastic layer 23, an adhesive layer is provided for the container 1 shown in FIGS. 1 to 3. In yet another variation (not shown), instead of the adhesive layer 43, a heat-sealable plastic layer is provided for the container 31 as shown in FIGS. 4 to 6. In still a further embodiment (not shown), instead of the adhesive layers 55, 56, 57, heat-sealable plastic layers are provided for the container 51 shown in FIGS. 7 and 8.

As can be ascertained from the drawings and the above description, all attaching surfaces 17, 18, 37, 38, 52, 53, 54 extend transversely to the circumferential direction A, B of the relevant containers 1, 31, 51. Attaching surfaces which extend in circumferential direction A, B are neither provided nor necessary. In containers 1 and 31, an additional attaching surface corresponding to the attaching surface 54 as shown in FIGS. 7 and 8 can, of course, be applied.

Although the invention has been described and illustrated in detail, it is to be clearly understood that the same is by way of illustration and example, and is not to be taken by way of limitation. The spirit and scope of the present invention are to be limited only by the terms of the appended claims.

What is claimed is:

1. A heat insulating container, comprising an inner container and a sleeve having cut edges extending transversely to a circumferential direction of the container and via attaching surfaces operatively associated with a circumferential wall of the inner container, wherein each of the attaching surfaces with a pre-applied adhesive layer extending transversely to the circumferential direction of the container so as to be pressingly held against the circumferential wall.

2. The container according to claim 1, wherein at least some of the attaching surfaces are arranged at border areas of the cut edges.

3. The container according to claim 2, wherein at least one additional attaching surface is arranged at a distance to the cut edges.

4. The container according to claim 3, wherein the additional attaching surface is arranged approximately halfway between the cut edges.

5. The container according to claim 1, wherein the sleeve is attached to the circumferential wall of the inner container with a tensile stress oriented in the circumferential direction.

6. The container according to claim 1, wherein the sleeve has profilings projecting at least one of inwardly and outwardly.

7. The container according to claim 6, wherein the attaching surfaces are associated with the profilings.

8. The container according to claim 1, wherein the sleeve comprises only one heat insulating material layer.

9. The container according to claim 1, wherein at least one of the sleeve and the inner container comprises at least one material layer made of one of paper and cardboard.

10. A heat insulating container comprising an inner container and a sleeve made by a process which include the steps of making said sleeve from a flat blank with attaching surfaces, wrapping the sleeve around the inner container such that cut edges come to rest transversely to a circumferential direction and face each other, operatively associating the blank with adhesive applied to the attaching surfaces in a single procedural step with the inner container at border areas adjacent to the cut edges wherein after the attaching surfaces are pressed against a circumferential wall of the inner container.

11. The container according to claim 10, wherein the blank is wrapped around the inner container with a tensile stress oriented in circumferential direction, and the tensile stress is maintained until the blank is attached to the inner container.

12. A process for making a heat insulating container having an inner container and a sleeve, comprising the steps of making said sleeve from a flat blank, wrapping the sleeve around the inner container such that cut edges come to rest transversely to a circumferential direction and face each other, attaching the blank with attaching surfaces in a single procedural step to the inner container at border areas, adjacent to the cut edges, wherein an adhesive layer is applied to each attaching surface, whereafter the attaching surfaces are pressed against the circumferential wall of the inner container.

13. A process for making a heat insulating container having an inner container and a sleeve, comprising the steps of making said sleeve from a flat blank, wrapping the sleeve around the inner container such that cut edges come to rest transversely to a circumferential direction and face each other, attaching the blank with attaching surfaces in a single procedural step to the inner container at border areas, adjacent to the cut edges.

14. The process according to claim 13, wherein an adhesive layer is applied to the circumferential wall of the inner container before the blank is attached, whereafter the border areas adjacent to the cut edges are pressed onto the adhesive layer.

15. The process according to claim 13, wherein the blank is wrapped around the inner container with a tensile stress oriented in circumferential direction, and the tensile stress is maintained until the blank is attached to the inner container.

16. The process according to claim 15, wherein an adhesive layer is applied to the circumferential wall of the inner container before the blank is attached, whereafter the border areas adjacent to the cut edges are pressed onto the adhesive layer.

17. A process for making a heat insulating container having an inner container and a sleeve, comprising the steps of making said sleeve from a flat blank, wrapping the sleeve around the inner container such that cut edges come to rest transversely to a circumferential direction and face each other, attaching the blank with attaching surfaces in a single procedural step to the inner container at border areas, adjacent to the cut edges, wherein the blank is wrapped around the inner container with a tensile stress oriented in circumferential direction, and the tensile stress is maintained until the blank is attached to the inner container, and an adhesive layer is applied to each attaching surface, whereafter the attaching surfaces are pressed against the circumferential wall of the inner container.

* * * * *